US012258773B2

(12) United States Patent
Choi

(10) Patent No.: US 12,258,773 B2
(45) Date of Patent: Mar. 25, 2025

(54) TENT FRAME WITH MINIMIZED SIZE WHEN FOLDED

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 134 days.

(21) Appl. No.: 18/184,487

(22) Filed: Mar. 15, 2023

(65) Prior Publication Data

US 2023/0295951 A1 Sep. 21, 2023

(30) Foreign Application Priority Data

Mar. 16, 2022 (CN) ..... 202220617720.2

(51) Int. Cl.
*E04H 15/50* (2006.01)
*E04H 15/48* (2006.01)
*E04H 15/38* (2006.01)

(52) U.S. Cl.
CPC ..... *E04H 15/50* (2013.01); *E04H 15/48* (2013.01); *E04H 15/38* (2013.01)

(58) Field of Classification Search
None
See application file for complete search history.

(56) References Cited

U.S. PATENT DOCUMENTS 1,061,547 A 5/1913 Kennedy
1,347,107 A 7/1920 McCann
3,888,056 A 6/1975 Kelly
4,286,612 A 9/1981 Neal
4,630,627 A 12/1986 Windows
4,641,676 A 2/1987 Lynch
4,793,371 A 12/1988 O'Ferrell
4,944,321 A 7/1990 Moyet-Ortiz
5,224,507 A 7/1993 Vosse
5,275,188 A 1/1994 Tsai
(Continued)

FOREIGN PATENT DOCUMENTS

CA 2895981 A1 12/2015
CN 2401649 Y 10/2000
(Continued)

*Primary Examiner* — David R Dunn
*Assistant Examiner* — Danielle Jackson
(74) *Attorney, Agent, or Firm* — MORGAN, LEWIS & BOCKIUS LLP

(57) ABSTRACT

A tent frame includes extension poles, first connectors and supporting poles. For each respective extension pole, the corresponding first connector includes a first coupling member and a second coupling member facing away from a central axis of the tent frame. The corresponding supporting pole has an upper end connected to the first coupling member of the corresponding first connector and the respective extension pole has an end pivotally connected to the second coupling member of the corresponding first connector. At least a first portion of the corresponding supporting pole has a first surface that is substantially flat and faces away from the central axis of the tent frame. When the frame is folded, the respective extension pole is folded onto the first surface of the corresponding supporting pole, and thus minimizes a size of the tent frame when folded.

20 Claims, 8 Drawing Sheets

(56) References Cited

U.S. PATENT DOCUMENTS

| | | | | |
|---|---|---|---|---|
| 5,421,356 | A | 6/1995 | Lynch | |
| 5,794,640 | A | 8/1998 | Jang | |
| 5,813,425 | A | 9/1998 | Carter | |
| 5,944,040 | A | 8/1999 | Jang | |
| 6,182,917 | B1 | 2/2001 | Lai | |
| 6,206,020 | B1 | 3/2001 | Lynch | |
| 6,463,948 | B2 | 10/2002 | Lee | |
| 6,598,614 | B2 | 7/2003 | Liu | |
| 6,708,707 | B2 | 3/2004 | Dotterweich | |
| 6,718,995 | B2 | 4/2004 | Dotterweich | |
| 6,848,461 | B2 | 2/2005 | Tsai | |
| 6,874,519 | B2 * | 4/2005 | Chiang | E04H 15/50 135/147 |
| 6,929,017 | B2 | 8/2005 | Byun | |
| 7,055,538 | B2 | 6/2006 | Deng | |
| 7,240,686 | B2 | 7/2007 | Seo | |
| 7,296,584 | B2 | 11/2007 | Goldwitz | |
| 7,299,813 | B2 | 11/2007 | Ochi | |
| 7,316,239 | B2 | 1/2008 | Yang | |
| 7,360,549 | B2 | 4/2008 | Seo | |
| 7,395,830 | B2 | 7/2008 | Seo | |
| 7,422,026 | B2 | 9/2008 | Kim | |
| 7,637,275 | B2 * | 12/2009 | Stehly | E04H 15/50 52/79.5 |
| 8,220,477 | B2 | 7/2012 | Park | |
| 8,613,177 | B2 * | 12/2013 | Pili | E04H 15/48 52/645 |
| 8,616,226 | B2 | 12/2013 | Ma | |
| 8,701,692 | B2 | 4/2014 | Holland | |
| D705,884 | S | 5/2014 | Jin | |
| 8,746,267 | B2 * | 6/2014 | Lovley, II | F16B 7/1454 135/120.2 |
| 8,776,816 | B2 | 7/2014 | Danziger | |
| 8,893,737 | B2 | 11/2014 | Yang | |
| 8,910,648 | B2 | 12/2014 | Jin | |
| 9,243,422 | B2 | 1/2016 | Hunt | |
| 9,482,026 | B2 * | 11/2016 | Ampoyo | E04H 15/505 |
| 9,528,292 | B1 * | 12/2016 | Lovley, II | E04H 15/50 |
| 9,580,929 | B2 | 2/2017 | Ma | |
| 9,739,073 | B2 | 8/2017 | Huang | |
| 9,869,110 | B2 | 1/2018 | Krenzel | |
| 9,926,720 | B2 | 3/2018 | Huang | |
| 9,995,056 | B2 * | 6/2018 | Yang | E04H 15/50 |
| 10,113,329 | B2 * | 10/2018 | Choi | E04H 15/46 |
| 10,253,523 | B2 * | 4/2019 | Volin | E04H 15/50 |
| 10,309,121 | B2 * | 6/2019 | Choi | E04H 15/50 |
| 10,745,934 | B2 * | 8/2020 | Choi | E04H 15/48 |
| 11,225,809 | B2 * | 1/2022 | Choi | E04H 15/18 |
| 12,084,879 | B2 * | 9/2024 | Yang | E04H 15/52 |
| 2001/0050098 | A1 | 12/2001 | Lee | |
| 2002/0074032 | A1 | 6/2002 | Park | |
| 2004/0144412 | A1 | 7/2004 | Tsai | |
| 2005/0241688 | A1 | 11/2005 | Wu | |
| 2006/0169312 | A1 | 8/2006 | Choi | |
| 2007/0012347 | A1 | 1/2007 | Ochi | |
| 2007/0051397 | A1 | 3/2007 | Choi | |
| 2007/0144572 | A1 | 6/2007 | Patel | |
| 2007/0186967 | A1 * | 8/2007 | Zingerle | E04H 15/50 135/145 |
| 2009/0032079 | A1 | 2/2009 | Choi | |
| 2010/0043856 | A1 | 2/2010 | Park | |
| 2011/0073148 | A1 | 3/2011 | Choi | |
| 2011/0308559 | A1 * | 12/2011 | Ma | E04H 15/38 135/122 |
| 2012/0291830 | A1 | 11/2012 | Crimi | |
| 2013/0014794 | A1 | 1/2013 | Jin | |
| 2013/0247948 | A1 | 9/2013 | Lovely et al. | |
| 2013/0284225 | A1 | 10/2013 | Holland | |
| 2014/0174491 | A1 | 6/2014 | Yang | |
| 2014/0261601 | A1 | 9/2014 | Jin | |
| 2014/0261602 | A1 | 9/2014 | Ampoyo | |
| 2014/0290710 | A1 | 10/2014 | Choi | |
| 2015/0083177 | A1 | 3/2015 | Hotes | |
| 2015/0247339 | A1 | 9/2015 | Lee | |
| 2015/0308147 | A1 | 10/2015 | Lee | |
| 2015/0376913 | A1 | 12/2015 | Choi | |
| 2016/0108639 | A1 * | 4/2016 | Huang | E04H 15/50 135/144 |
| 2016/0348392 | A1 | 12/2016 | Jin | |
| 2017/0121999 | A1 | 5/2017 | Ma | |
| 2017/0292287 | A1 | 10/2017 | Lovely, II | |
| 2018/0080242 | A1 | 3/2018 | Choi | |
| 2018/0080243 | A1 | 3/2018 | Choi | |
| 2018/0106066 | A1 | 4/2018 | Choi | |
| 2018/0106067 | A1 | 4/2018 | Choi | |
| 2018/0106068 | A1 * | 4/2018 | Choi | E04H 15/46 |
| 2018/0142493 | A1 | 5/2018 | Choi | |
| 2019/0234102 | A1 * | 8/2019 | Lu | E04H 15/50 |

FOREIGN PATENT DOCUMENTS

| | | | | |
|---|---|---|---|---|
| CN | 201202302 | Y | 3/2009 | |
| CN | 103590650 | B | 2/2014 | |
| CN | 104265063 | A | 1/2015 | |
| CN | 104358468 | A | 2/2015 | |
| CN | 204163467 | U | 2/2015 | |
| FR | 1 121 851 | | 8/1956 | |
| FR | 68588 | | 5/1958 | |
| FR | 2927641 | A1 * | 8/2009 | E04H 15/50 |
| FR | 3012835 | A1 * | 5/2015 | E04H 15/50 |
| JP | 4557885 | B2 | 10/2010 | |
| WO | WO 2010/104939 | A1 | 9/2010 | |
| WO | WO 2011/022764 | A1 | 3/2011 | |
| WO | WO 2013/116545 | A1 | 8/2013 | |
| WO | WO-2023185730 | A1 * | 10/2023 | |

* cited by examiner

TENT FRAME WITH MINIMIZED SIZE WHEN FOLDED

CROSS-REFERENCE TO RELATED APPLICATION

This application claims priority to Chinese Patent Application No. 202220617720.2 filed on Mar 16, 2022, the entire contents of which are incorporated herein for all purposes by this reference.

FIELD OF THE INVENTION

The present disclosure relates to tent frames, and, more particularly, to tent frames with minimized sizes when folded.

BACKGROUND

Conventional tents include supporting poles, an upper frame supported by the supporting poles and a tent cloth covering the upper frame. The shaded region provided by a tent is proportional to an area formed by the tent cloth. Increasing the shaded region requires enlarging the tent frame, for instance, by using longer tent poles and/or adding more tent poles. This leads to bigger and heavier tents and tent frames, making them inconvenient to use and carry around.

Accordingly, there remains a need for improved tent and tent frames.

BRIEF SUMMARY

The present disclosure addresses these and/or other issues in the art by providing tent frames that allow the tents to provide larger shaded regions when unfolded while minimizing the sizes of the tent frames (and the tents) when folded.

In various exemplary embodiments, the present disclosure provides a tent frame. The tent frame includes a plurality of extension poles, a plurality of first connectors and a plurality of supporting poles. There is a corresponding first connector in the plurality of first connectors for each respective extension pole in the plurality of extension poles, and there is a corresponding supporting pole in the plurality of supporting poles for each respective extension pole in the plurality of extension poles. The corresponding first connector includes a first coupling member and a second coupling member facing away from a central axis of the tent frame. The corresponding supporting pole has an upper end connected to the first coupling member of the corresponding first connector and the respective extension pole has an end pivotally connected to the second coupling member of the corresponding first connector. At least a first portion of the corresponding supporting pole has a first surface that is substantially flat and faces away from the central axis of the tent frame. When the frame is folded, the respective extension pole is folded onto the first surface of the corresponding supporting pole, thereby minimizing a size of the tent frame when folded.

In some exemplary embodiments, when the tent frame is folded, each respective extension pole in the plurality of extension poles is substantially parallel to the first surface of the corresponding supporting pole in the plurality of supporting poles.

In an exemplary embodiment, the plurality of extension poles has a number of extension poles less than a number of supporting poles in the plurality of supporting poles. In another exemplary embodiment, the plurality of extension poles has a number of extension poles the same as a number of supporting poles in the plurality of supporting poles. In some exemplary embodiments, each extension pole in the plurality of extension poles is an eave pole.

In some exemplary embodiments, the first portion of the corresponding supporting pole includes the upper end of the corresponding supporting pole.

In some exemplary embodiments, the first portion of the corresponding supporting pole includes a second surface opposite to the first surface, wherein the second surface is curved, arched, or bent. In some such exemplary embodiments, the second surface includes a substantially flat first section and a substantially flat second section. In an exemplary embodiment, the first and second sections are substantially perpendicular to each other.

In some exemplary embodiments, the corresponding first connector further includes a first coupling member, a fourth coupling member and a fifth coupling member. The third coupling member is at a first side of the corresponding first connector and connected to a side pole. The fourth coupling member is at a second side of the correcting member and connected to another side pole. The fifth coupling member faces the central axis of the tent frame and is connected to an upper pole.

In some exemplary embodiments, the tent frame further includes a plurality of second connectors and a plurality of auxiliary poles. There is a corresponding second connector in the plurality of second connectors for each respective extension pole in the plurality of extension poles, and there is a corresponding auxiliary pole in the plurality of auxiliary poles for each respective extension pole in the plurality of extension poles. The corresponding second connector is slidably coupled with the corresponding supporting pole and movable along the corresponding supporting pole. The corresponding auxiliary pole has an end pivotally connected to the respective extension pole and another end pivotally connected to the corresponding second connector.

In some exemplary embodiments, the tent frame further includes a hub and a plurality of upper pole units. Each of the plurality of upper pole units is disposed between the hub and the corresponding supporting pole in the plurality of supporting poles. Each of the plurality of upper pole units has an end pivotally connected to the hub and another end pivotally connected to the corresponding supporting pole.

In some exemplary embodiments, the tent frame further includes a push-pull unit. The push-pull unit includes a central pole, and a plurality of push-pull poles. Each of the plurality of push-pull poles has an end pivotally connected to a corresponding upper pole unit in the plurality of upper pole units and another end pivotally connected to the central pole.

In an exemplary embodiment, the central pole has an upper end removably connected to the hub.

In some exemplary embodiments, the tent frame further includes a plurality of side pole units. Each of the plurality of side pole units is disposed between two adjacent supporting poles, and has an end pivotally connected to one of the two adjacent supporting poles and another end pivotally connected to another of the two adjacent supporting poles.

In some exemplary embodiments, each side pole unit in the plurality of side pole units includes one or more side pole pairs connected with each other. Each side pole pair includes first and second side poles crossly and pivotally connected with each other. Each of the first and second side poles has a cross section of a substantially "D" shape. For each side pole pair, substantially straight edges of the "D" shapes of the first and second side poles face each other.

In various exemplary embodiments, the present disclosure provides a tent frame. The tent frame includes a plurality of supporting poles, a plurality of first connectors, a plurality of second connectors, and a plurality of side pole units. Each of the plurality of first connectors is fixedly connected to an upper end of a corresponding supporting pole in the plurality of supporting poles. Each of the plurality of second connectors is slidably coupled with the corresponding supporting pole in the plurality of supporting poles and movable along the corresponding supporting pole. Each of the plurality of side pole units is disposed between two adjacent supporting poles. Each side pole unit in the plurality of side pole units includes one or more side pole pairs connected with each other. Each side pole pair includes first and second side poles crossly and pivotally connected with each other. Each of the first and second side poles adjacent a supporting pole in the two adjacent supporting poles has an end portion pivotally connected with the first or second connector at the supporting pole. Each of the first and second side poles has a cross section of a substantially "D" shape. For each side pole pair, substantially straight edges of the "D" shapes of the first and second side poles face each other.

In some exemplary embodiments, the tent frame further includes a hub and a plurality of upper pole units. Each of the plurality of upper pole units is disposed between the hub and the corresponding supporting pole in the plurality of supporting poles. Each of the plurality of upper pole units has an end pivotally connected to the hub and another end pivotally connected to the first connector at the corresponding supporting pole.

In some exemplary embodiments, the tent frame further includes a push-pull unit. The push-pull unit includes a central pole, and a plurality of push-pull poles. Each of the plurality of push-pull poles has an end pivotally connected to a corresponding upper pole unit in the plurality of upper pole units and another end pivotally connected to the central pole.

In various exemplary embodiments, the present disclosure provides a tent frame. The tent frame includes a plurality of supporting poles and a plurality of first connectors each fixedly connected to an upper end of a corresponding supporting pole in the plurality of supporting poles. The tent frame also includes a hub and a plurality of upper pole units. Each of the plurality of upper pole units is disposed between the hub and the corresponding supporting pole in the plurality of supporting poles, and has an end pivotally connected to the hub and another end pivotally connected to the first connector at the corresponding supporting pole. The tent frame further includes a push-pull unit. The push-pull unit includes a central pole, and a plurality of push-pull poles. Each of the plurality of push-pull poles has an end pivotally connected to a corresponding upper pole unit in the plurality of upper pole units and another end pivotally connected to the central pole.

In some exemplary embodiments, the central pole has an upper end removably connected to the hub.

The tent frames of the present invention have other features and advantages that will be apparent from, or are set forth in more detail in the accompanying drawings, which are incorporated herein, and the following Detailed Description, which together serve to explain certain principles of the exemplary embodiments of the present invention.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention. The accompanying drawings are not necessarily to scale. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing. In addition, the components illustrated in the figures are combinable in any useful number and combination.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will also be understood that, although the terms first, second, etc. may be used herein to describe various elements, these elements should not be limited by these terms. These terms are only used to distinguish one element from another. For example, a first connector could be termed a second connector, and, similarly, a second connector could be termed a first connector, without departing from the scope of the present disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The present disclosure provides a tent frame that allows the tent (e.g., a tent using the tent frame of the present disclosure) to provide more shaded regions when it is unfolded while minimizing the size when it is folded. The tent frame can be of various sizes and shapes.

Referring to FIGS. 3-8, there is shown an exemplary tent frame 1 in accordance with some exemplary embodiments of the present disclosure. The tent frame includes a plurality of supporting poles, such as supporting pole 200. While it is illustrated that tent frame 1 has four supporting poles, it should be noted that this is by way of example. The present disclosure is not limited thereto. For instance, in some exemplary embodiments, the tent frame can include less than four supporting poles (e.g., three supporting poles) or more than four supporting poles (e.g., five, six, or more than six supporting poles).

Figure 3:
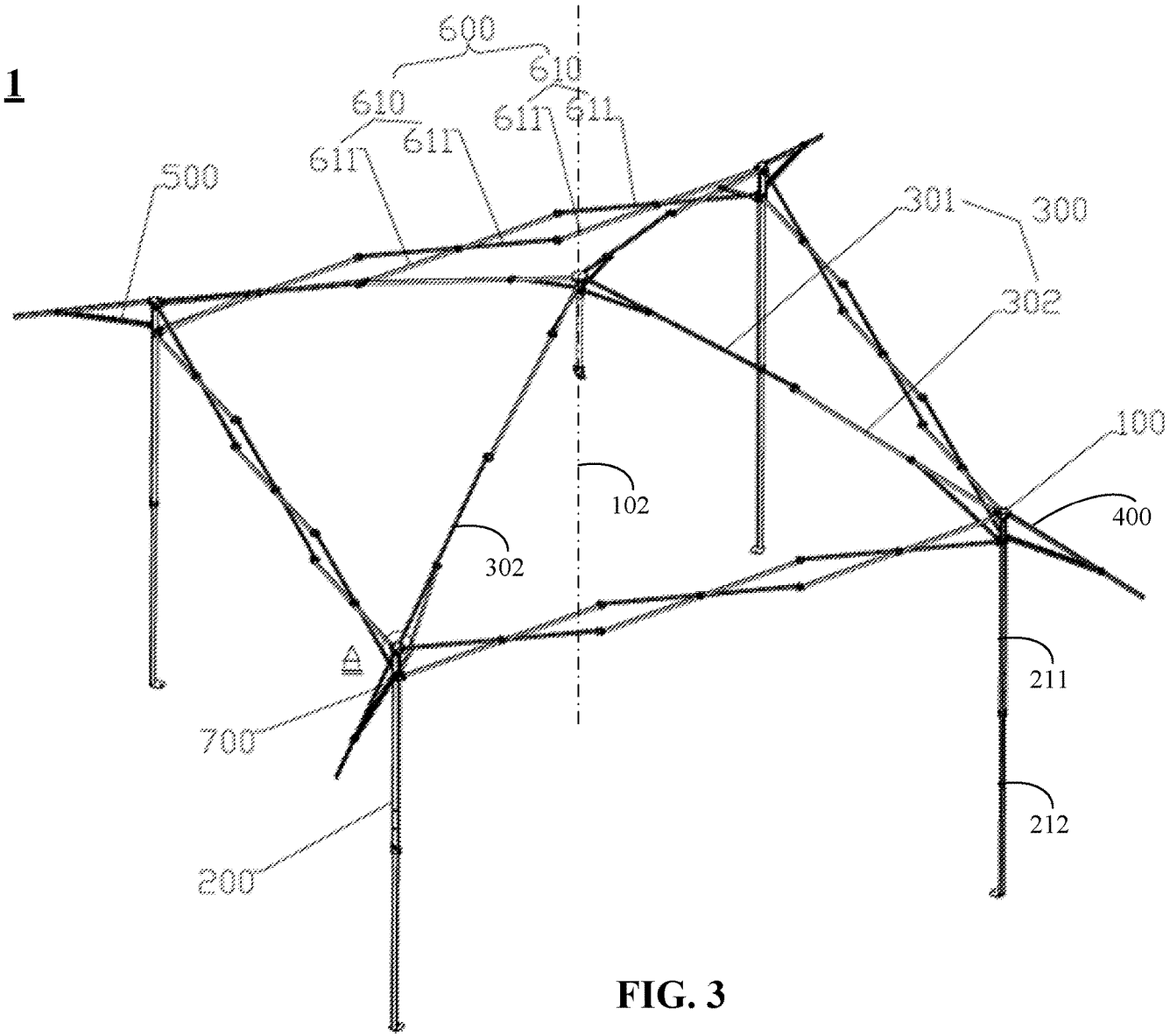
FIG. 3 is a schematic diagram illustrating a tent frame in an unfolded state in accordance with some exemplary embodiments of the present invention.
Figure 4:
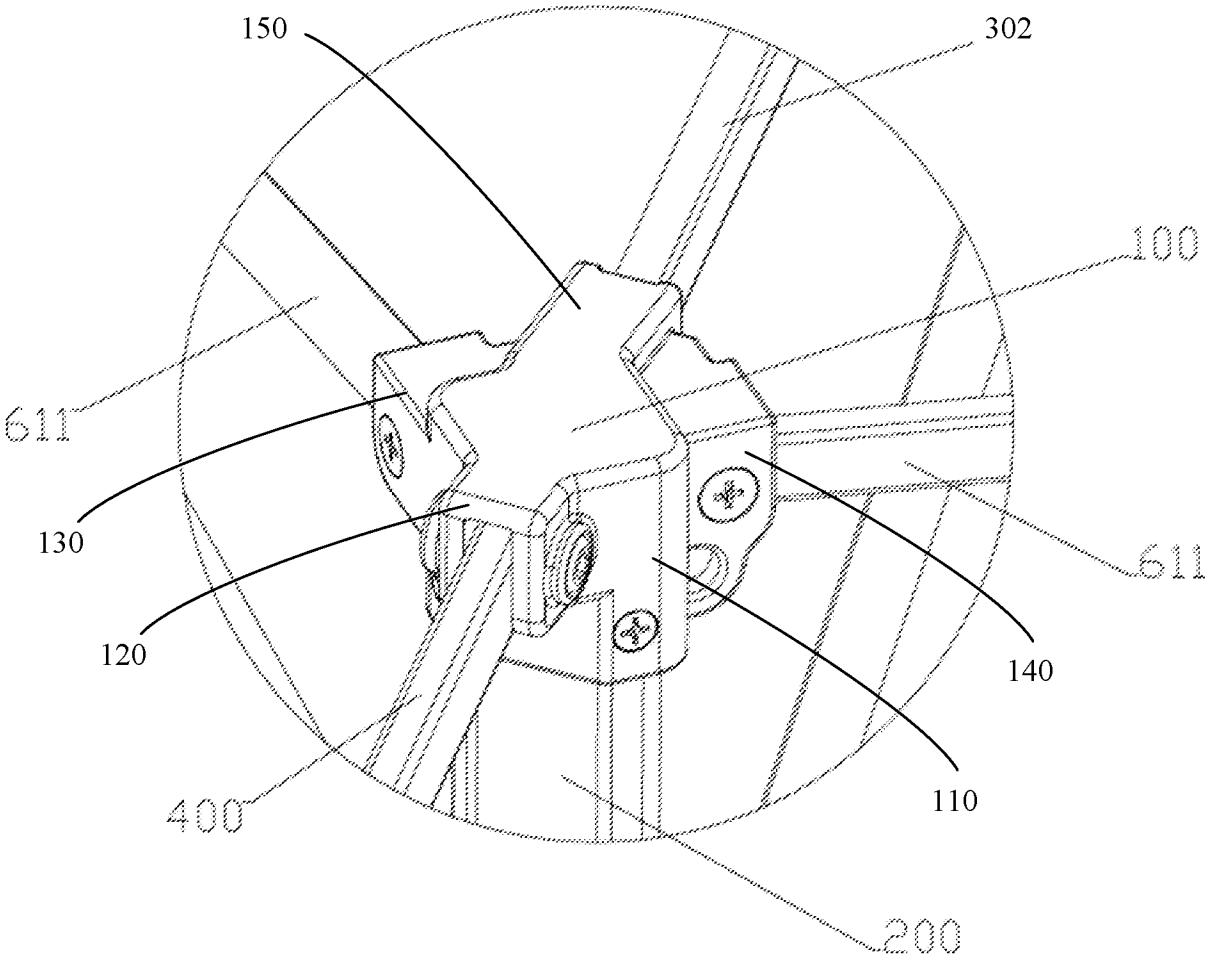
FIG. 4 is an enlarged view taken along circle A in FIG. 3.
Figure 5:
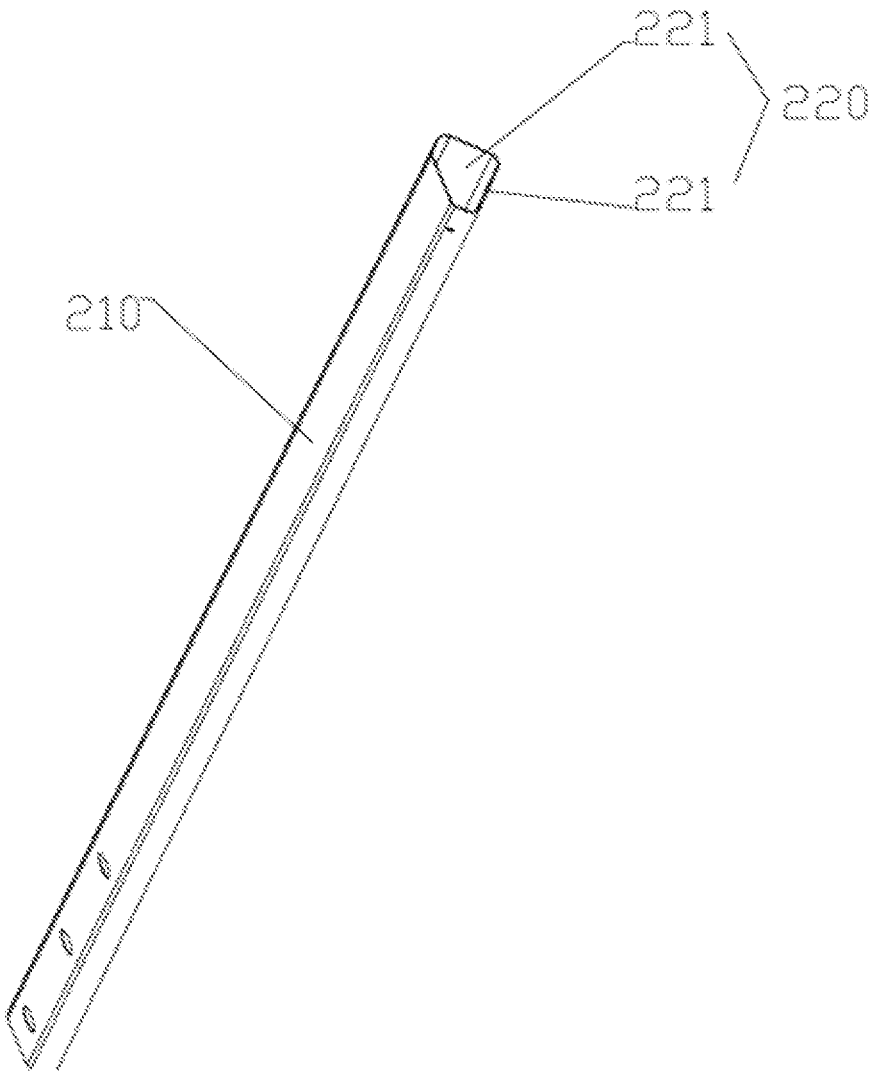
FIG. 5 is a schematic diagram illustrating a supporting pole of the tent frame of FIG. 3 in accordance with some exemplary embodiments of the present invention.

In some exemplary embodiments, at least a first portion of the corresponding supporting pole 200 has a first surface, e.g., first surface 210. The first surface is substantially flat as illustrated in FIG. 5. When the tent frame is folded, first surface 210 faces away from a central axis of the tent frame, such as central axis 102 illustrated in FIG. 8. In some exemplary embodiments, when the tent frame is unfolded, first surface 210 also faces away from central axis 102 of the tent frame as illustrated in FIGS. 3 and 4. The central axis can be but do not have to be exactly the center line of the tent frame. In the illustrated embodiment, the central axis 102 is aligned substantially with the center line of the tent frame when the tent is fully unfolded or fully folded.

In some exemplary embodiments, the first portion having first surface 210 includes an upper portion (which may or may not include the upper end) of the supporting pole. In some exemplary embodiments, the first portion having first surface 210 includes the entire upper portion (e.g., including the upper end) of the supporting pole. In some exemplary embodiments, the supporting pole includes an upper pole segment, such as upper pole segment 211, and a lower pole segment, such as lower pole segment 212. The upper and lower pole segments are telescopically coupled with each other. In some such embodiments, the first portion having first surface 210 includes the upper pole segment of the supporting pole.

In some exemplary embodiments, the first portion of the supporting pole includes a second surface, such as second surface 220, opposite to the first surface 210. The second surface is curved, arched, or bent. In some such embodiments, the second surface includes a substantially flat first section and a substantially flat second section, e.g., the two sections 221 illustrated in FIG. 5. In some exemplary embodiments, the first and second sections are substantially perpendicular to each other.

Tent frame 1 also includes a plurality of first connectors, such as first connector 100. Each first connector in the plurality of first connectors is disposed at an upper end of a corresponding supporting pole in the plurality of supporting poles. For instance, in some exemplary embodiments, first connector 100 includes a first coupling member, such as first coupling member 110. In some exemplary embodiments, the first coupling member faces downward (e.g., face the ground) when the tent frame is unfolded or in use. In some exemplary embodiments, the upper end of the supporting pole is fixedly coupled with the first coupling member of the first connector, for instance, by snap-fit, press-fit, fastener or the like.

In some exemplary embodiments, first connector 100 includes one or more side coupling members for connecting the supporting pole with other poles of the tent frame. For instance, in some exemplary embodiments, first connector 100 includes a second coupling member, such as second coupling member 120, that faces away from central axis 102 of the tent frame. In some exemplary embodiments, first connector 100 includes a third coupling member, such as third coupling member 130, a fourth coupling member, such as fourth coupling member 140, and a fifth coupling member, such as fifth coupling member 150. Third coupling member 130 is at a first side of first connector 100 and connected to a side pole of the tent frame, e.g., side pole 611 at the left-hand side of FIG. 4. Fourth coupling member 140 is at a second side of first connector 100 and connected to another side pole of the tent frame, e.g., side pole 611 at the right-hand side of FIG. 4. Fifth coupling member 150 faces central axis 102 of the tent frame and is connected to an upper pole of the tent frame, e.g., upper pole 302 in FIG. 4.

In some exemplary embodiments, tent frame 1 includes a plurality of extension poles, such as extension pole 400. In some exemplary embodiments, each extension pole in the plurality of extension poles is an eave pole.

The number of extension poles, the number of supporting poles and the number of first connectors can be the same as each other or different from each other. Generally, the number of extension poles does not exceed the number of supporting poles or the number of first connectors such that for each respective extension pole in the plurality of extension poles, there is a corresponding supporting pole and a corresponding first connector. For instance, as a non-limiting example, a tent frame can include four supporting poles but only two extension poles. As another non-limiting example, a tent frame can include four supporting poles but only three extension poles. As a further non-limiting example, a tent frame can include four supporting poles and four extension poles.

For each respective extension pole 400 in the plurality of extension poles, at least the first portion of the corresponding supporting pole 200 has first surface 210 that is substantially flat and faces away from the central axis 102 of the tent frame. The corresponding supporting pole 200 has an upper end connected to the first coupling member 110 of the corresponding first connector and the respective extension pole 400 has an end pivotally connected to the second coupling member 120 of the corresponding first connector. When the frame is folded, respective extension pole 400 is folded onto first surface 210 of the corresponding supporting pole 200, thereby minimizing a size of the tent frame when folded. In some exemplary embodiments, when the tent frame is folded, each respective extension pole 400 in the plurality of extension poles is substantially parallel to the first surface 210 of the corresponding supporting pole 200 in the plurality of supporting poles.

Figure 1:
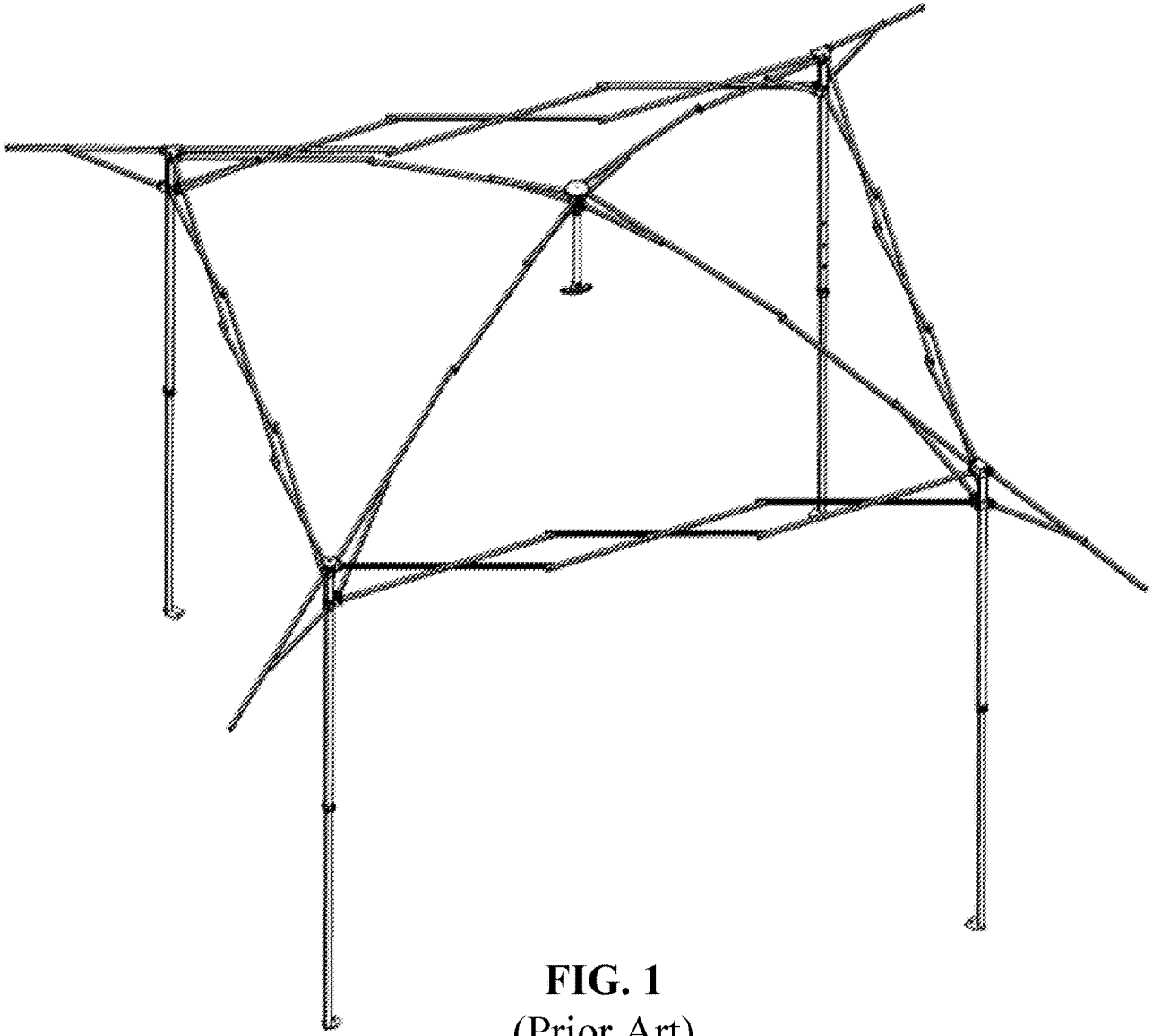
FIG. 1 (Prior Art)
FIG. 1 is a schematic diagram illustrating a tent frame in an unfolded state according to the prior art.
Figure 2:
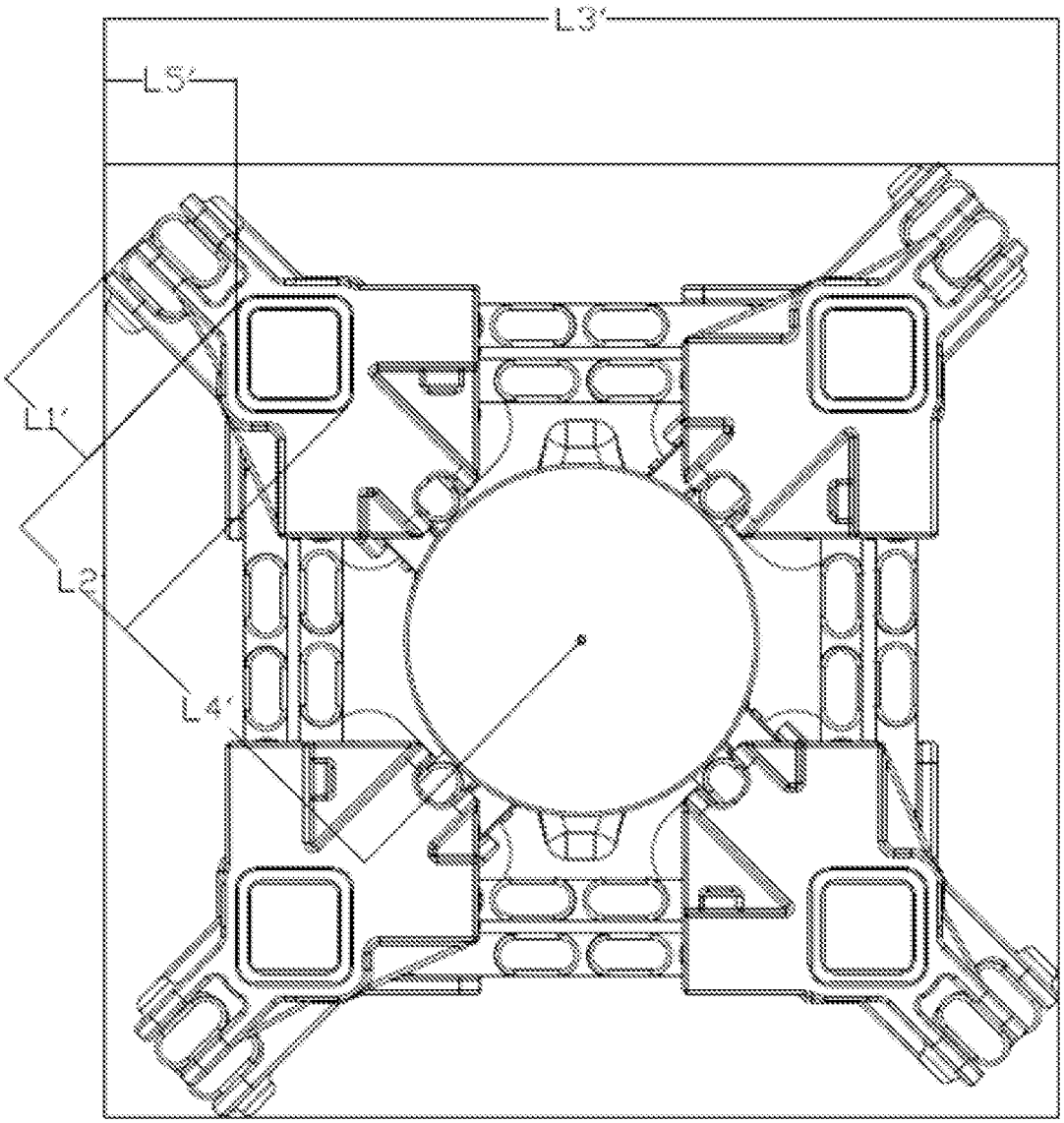
FIG. 2 (Prior Art)
FIG. 2 is a cutout view illustrating the tent frame of FIG. 1 in a folded state.
Figure 8:
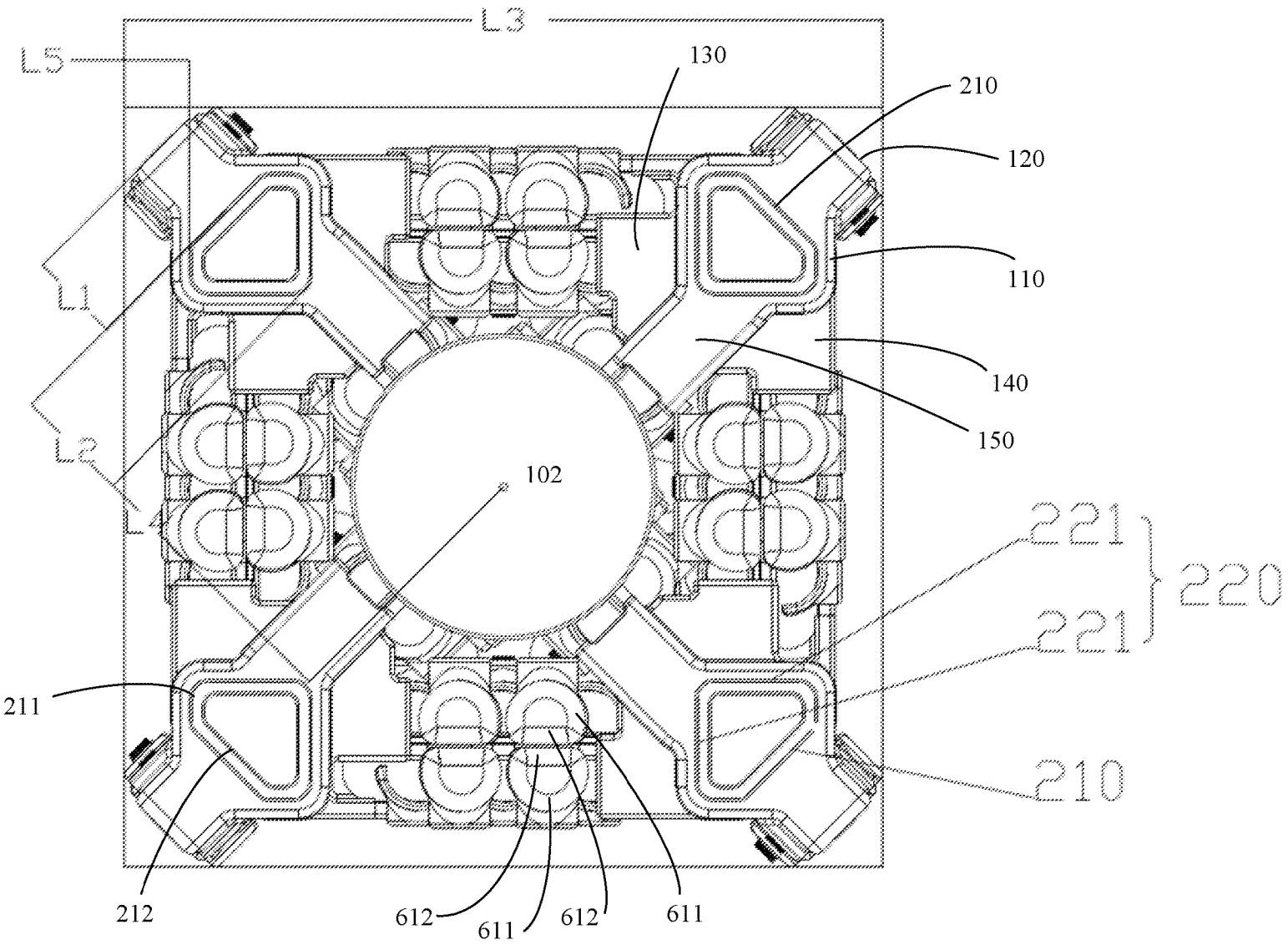
FIG. 8 is a cutout view taken along plane B in FIG. 7.

For instance, referring in particular to FIG. 8, L2 represents a radial dimension (e.g., a dimension in the radial direction with respect to central axis 102) of supporting pole 200 when the tent frame is folded. L1 represents a radial dimension from the radially outermost surface of first connector 100 to first surface 210 of supporting pole 200 when the tent frame is folded. L4 represents a radial dimension from the radially innermost surface/line/ point of supporting pole 200 to central axis 102 when the tent frame is folded. L3 represents an overall dimension (e.g., an overall width) of the tent frame when folded. Compared to the conventional tent frame illustrated in FIGS. 1 and 2 where the existing supporting pole has a substantially square cross section, the radial dimension L2 of supporting pole 200 is smaller than L2' (the diagonal of the existing supporting pole) in FIG. 2 even when supporting pole 200 has the same width as the existing supporting pole. Because first surface 210 of the corresponding supporting pole 200 is substantially flat and faces away from the central axis 102 of the tent frame (e.g., substantially perpendicular to the radial direction), and because respective extension pole 400 is folded onto first surface 210 of the corresponding supporting pole 200, the overall dimension L3 of tent frame 1 is smaller than the overall dimension L3' of the existing tent frame even when the other dimensions are the same (e.g., L1=L1', L4=L4', and L5=L5').

In some exemplary embodiments, tent frame 1 includes a plurality of second connectors, such as second connector 700. Second connector 700 is slidably coupled with a corresponding supporting pole 200 and movable along the corresponding supporting pole below the corresponding first connector. In some exemplary embodiments, there is a corresponding second connector for each respective extension pole in the plurality of extension poles.

In some exemplary embodiments, tent frame 1 includes a plurality of auxiliary poles, such as auxiliary pole 500. In some exemplary embodiments, there is a corresponding auxiliary pole for each respective extension pole in the plurality of extension poles. In some exemplary embodiments, the corresponding auxiliary pole has an end pivotally connected to the respective extension pole and another end pivotally connected to the corresponding second connector. The corresponding auxiliary pole helps to support the respective extension pole when the tent frame is unfolded, to guide the folding and unfolding of the respective extension pole, or both.

Referring in particular to FIGS. 3 and 8, in some exemplary embodiments, tent frame 1 includes a plurality of side pole units, such as side pole unit 600. Each side pole unit 600 is disposed between two adjacent supporting poles 200. Each side pole unit 600 has an end pivotally connected to one of the two adjacent supporting poles and another end pivotally connected to another of the two adjacent supporting poles, for instance, through the first connectors, second connectors or both at the two adjacent supporting poles.

In some exemplary embodiments, each side pole unit 600 in the plurality of side pole units includes one or more side pole pairs, such as side pole pair 610, that are connected to each other. While it is illustrated that side pole unit 600 has three side pole pairs, it should be noted that each side pole unit can have less than three side pole pairs (e.g., one side pole pair or two side pole pairs) or more than three side pole pairs (e.g., four, five, or more than five side pole pairs). Each side pole pair 610 includes first and second side poles, e.g., side poles 611, crossly and pivotally connected with each other (e.g., having an "X" shape when unfolded). In some exemplary embodiments, each of the first and second side poles has a substantially flat surface, such as flat surface 612. For each side pole pair 610, the substantially flat surfaces 612 of the first and second side poles 611 face each other. In some exemplary embodiments, each of the first and second side poles has a cross section of a substantially "D" shape as illustrated in FIG. 8. With the substantially "D" shaped cross section, the first and second side poles allow the tent frame to maintain the strength and integrity when unfolded and to minimize the size when folded.

In some exemplary embodiments, tent frame 1 includes a hub, such as hub 800, and a plurality of upper pole units, such as upper pole unit 300. Each upper pole unit 300 is disposed between the hub and a corresponding supporting pole in the plurality of supporting poles. Each upper pole unit 300 has an end pivotally connected to the hub and another end pivotally connected to the first connector at the corresponding supporting pole. For instance, in some exemplary embodiments, each upper pole unit 300 includes a first upper pole, such as first upper pole 301, and a second upper pole, such as second upper pole 302. The first upper pole has an end pivotally connected to the hub, and the second upper pole has an end pivotally connected to the first connector (e.g., the fifth coupling member of the first connector). The first and second upper poles are pivotally connected to each other.

Figure 6:
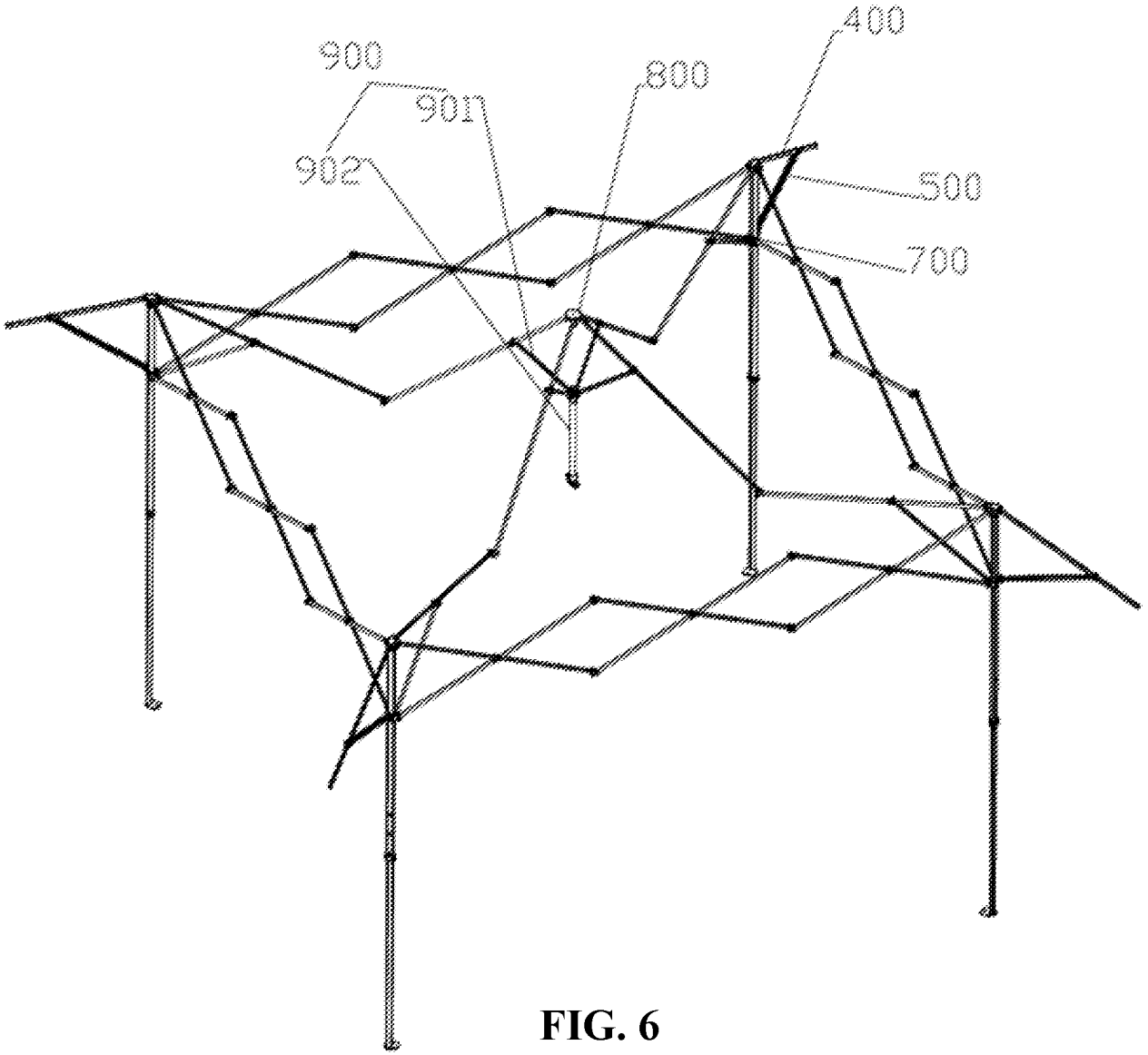
FIG. 6 is a schematic diagram illustrating the tent frame of FIG. 3 in an intermediate state in accordance with some exemplary embodiments of the present invention.
Figure 7:
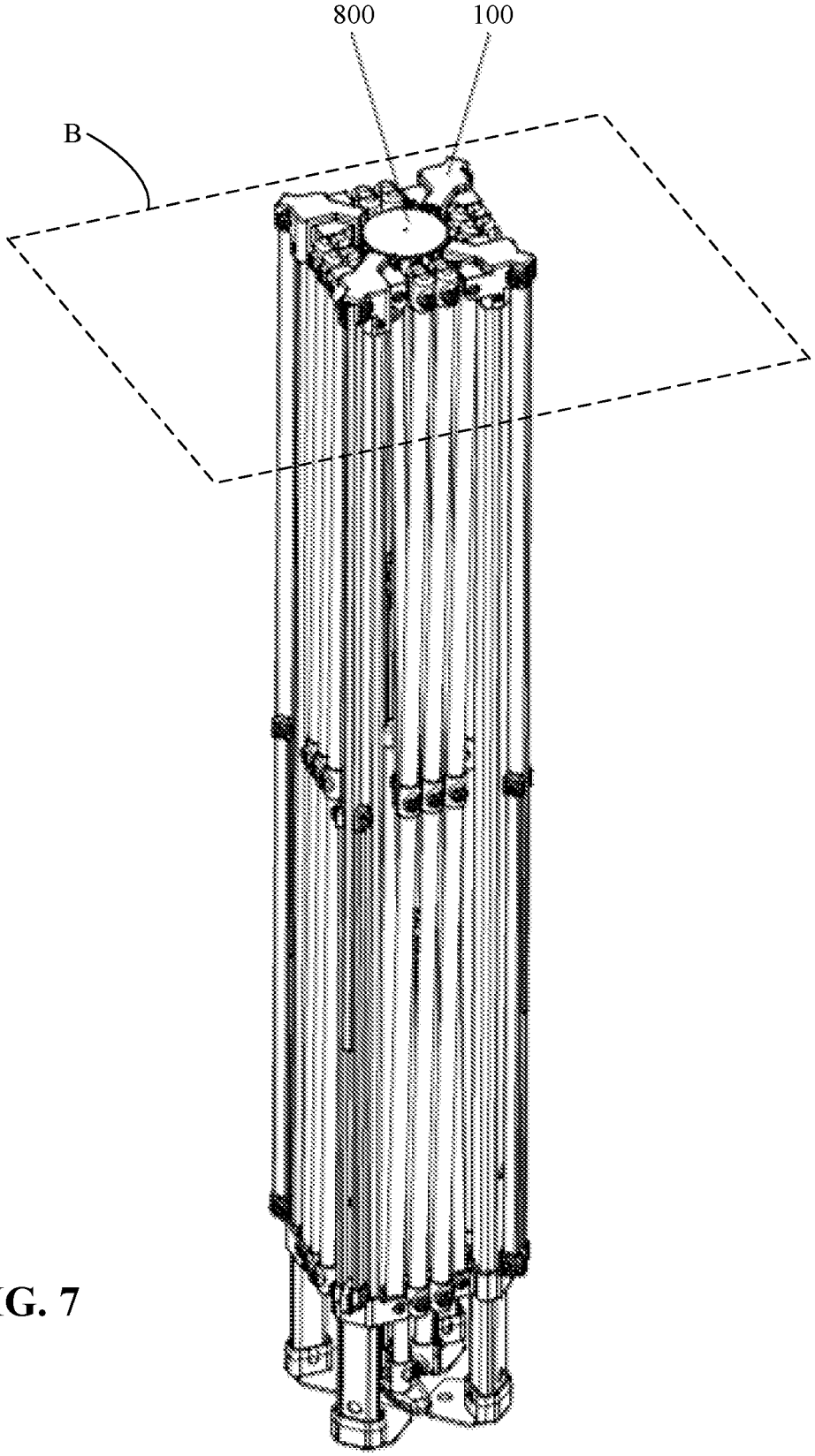
FIG. 7 is a schematic diagram illustrating the tent frame of FIG. 3 in a folded state in accordance with some exemplary embodiments of the present invention.

Referring in particular to FIGS. 3 and 6, in some exemplary embodiments, tent frame 1 includes a push-pull unit, such as push-pull unit 900. Push-pull unit 900 includes a central pole, such as central pole 902. In some exemplary embodiments, central pole 902 has an upper end removably connected to the hub. Push-pull unit 900 also includes a plurality of push-pull poles, such as push-pull pole 901. Each push-pull pole 901 has an end pivotally connected to a corresponding upper pole unit 300 (e.g., first upper pole 301) in the plurality of upper pole units and another end pivotally connected to the central pole. Push-pull unit 900 allows easy folding of the tent or tent frame. For instance, to fold the tent or tent frame, one can pull central pole 902 to pull downward push-pull poles 901. This causes upper pole units 300 to fold inward, side pole units 600 to fold crosswise, and extension poles 400 to fold downward.

When coupled with a tent cloth, tent frame 1 of the present disclosure can provide an enlarged shaded region when unfolded. When folded, the tent frame and the tent has a minimized size. As such, the tent frame (and the tent) requires less storage or packaging space, and is easy to use and carry.

For convenience in explanation and accurate definition in the appended claims, the terms "upper", "lower", "upward", "downward", "inward" and "outward" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tent frame, comprising:

a plurality of extension poles;

a plurality of first connectors, a corresponding first connector in the plurality of first connectors for each respective extension pole in the plurality of extension poles, wherein the corresponding first connector comprises a first coupling member and a second coupling member facing away from a central axis of the tent frame; and a plurality of supporting poles, a corresponding supporting pole in at least a subset of the plurality of supporting poles for each respective extension pole in the plurality of extension poles, wherein at least a first portion of the corresponding supporting pole comprises:

a first surface that is substantially flat and faces away from the central axis of the tent frame; and a second surface opposite to the first surface, wherein the second surface comprises at least a substantially flat first section and a substantially flat second section, and each of the substantially flat first and second sections is oblique to the first surface;

wherein the corresponding supporting pole has an upper end connected to the first coupling member of the corresponding first connector and the respective extension pole has an end pivotally connected to the second coupling member of the corresponding first connector such that when the frame is folded, the respective extension pole is folded onto the first surface of the corresponding supporting pole, thereby minimizing a size of the tent frame when folded.

2. The tent frame of claim 1, wherein when the tent frame is folded, each respective extension pole in the plurality of extension poles is substantially parallel to the first surface of the corresponding supporting pole in the plurality of supporting poles.

3. The tent frame of claim 1, wherein the plurality of extension poles has a number of extension poles less than a number of supporting poles in the plurality of supporting poles.

4. The tent frame of claim 1, wherein the plurality of extension poles has a number of extension poles the same as a number of supporting poles in the plurality of supporting poles.

5. The tent frame of claim 1, wherein each extension pole in the plurality of extension poles is an eave pole.

6. The tent frame of claim 1, wherein the first portion of the corresponding supporting pole comprises the upper end of the corresponding supporting pole.

7. The tent frame of claim 1, wherein the first and second sections are substantially perpendicular to each other.

8. The tent frame of claim 1, wherein the corresponding first connector further comprises:

a third coupling member at a first side of the corresponding first connector and connected to a side pole;

a fourth coupling member at a second side of the correcting member and connected to another side pole; and a fifth coupling member facing the central axis of the tent frame and connected to an upper pole.

9. The tent frame of claim 1, further comprising:

a plurality of second connectors, a corresponding second connector in the plurality of second connectors for each respective extension pole in the plurality of extension poles, wherein the corresponding second connector is slidably coupled with the corresponding supporting pole and movable along the corresponding supporting pole; and a plurality of auxiliary poles, a corresponding auxiliary pole in the plurality of auxiliary poles for each respective extension pole in the plurality of extension poles, wherein the corresponding auxiliary pole has an end pivotally connected to the respective extension pole and another end pivotally connected to the corresponding second connector.

10. The tent frame of claim 1, further comprising:

a hub; and a plurality of upper pole units, each disposed between the hub and the corresponding supporting pole in the plurality of supporting poles, and each having an end pivotally connected to the hub and another end pivotally connected to the corresponding supporting pole.

11. The tent frame of claim 10, further comprising:

a push-pull unit comprising:

a central pole; and a plurality of push-pull poles, each having an end pivotally connected to a corresponding upper pole unit in the plurality of upper pole units and another end pivotally connected to the central pole.

12. The tent frame of claim 11, wherein the central pole has an upper end removably connected to the hub.

13. The tent frame of claim 1, further comprising:

a plurality of side pole units, each disposed between two adjacent supporting poles, and each having an end pivotally connected to one of the two adjacent supporting poles and another end pivotally connected to another of the two adjacent supporting poles.

14. The tent frame of claim 13, wherein:

each side pole unit in the plurality of side pole units comprises one or more side pole pairs connected with each other;

each side pole pair comprises first and second side poles crossly and pivotally connected with each other;

each of the first and second side poles has a cross section of a substantially "D" shape; and for each side pole pair, substantially straight edges of the "D" shapes of the first and second side poles face each other.

15. The tent frame of claim 1, wherein the substantially flat first or second section is oblique to the first surface at an angle of about 45 degree.

16. The tent frame of claim 1, wherein at least the first portion of the corresponding supporting pole has a substantially triangular cross-sectional shape.

17. A tent frame, comprising:

a plurality of supporting poles;

a plurality of first connectors, each fixedly connected to an upper end of a corresponding supporting pole in the plurality of supporting poles;

a plurality of second connectors, each slidably coupled with the corresponding supporting pole in the plurality of supporting poles and movable along the corresponding supporting pole; and a plurality of side pole units, each disposed between two adjacent supporting poles, wherein each side pole unit in the plurality of side pole units comprises one or more side pole pairs connected with each other;

each side pole pair comprises first and second side poles crossly and pivotally connected with each other;

each of the first and second side poles adjacent a supporting pole in the two adjacent supporting poles has an end portion pivotally connected with the first or second connector at the supporting pole;

each of the first and second side poles has a cross section of a substantially "D" shape; and for each side pole pair, substantially straight edges of the "D" shapes of the first and second side poles face each other.

18. The tent frame of claim 17, further comprising:

a hub; and a plurality of upper pole units, each disposed between the hub and the corresponding supporting pole in the plurality of supporting poles, and each having an end pivotally connected to the hub and another end pivotally connected to the first connector at the corresponding supporting pole.

19. The tent frame of claim 18, further comprising:

a push-pull unit comprising:

a central pole; and a plurality of push-pull poles, each having an end pivotally connected to a corresponding upper pole unit in the plurality of upper pole units and another end pivotally connected to the central pole.

20. The tent frame of claim 19, wherein the central pole has an upper end removably connected to the hub.

* * * * *